United States Patent [19]

Gernhardt et al.

[11] 4,157,244

[45] Jun. 5, 1979

[54] GAS-COOLING METHOD AND APPARATUS

[75] Inventors: Paul Gernhardt, Bochum; Wolfgang Grams, Herne; Wilhelm Danguillier; Siegfried Pohl, both of Bochum, all of Fed. Rep. of Germany

[73] Assignees: Dr. C. Otto & Comp. GmbH., Bochum; Saarbergwerke A.C., Saarbrucken, both of Fed. Rep. of Germany; a part interest to each

[21] Appl. No.: 884,677

[22] Filed: Mar. 8, 1978

[30] Foreign Application Priority Data

Mar. 9, 1977 [DE] Fed. Rep. of Germany ..... 2710154

[51] Int. Cl.[2] ..... B01J 3/00

[52] U.S. Cl. ..... 48/62 R; 347/13; 347/57 R; 48/197 R; 48/210; 55/83; 55/261; 110/229; 261/17; 261/76

[58] Field of Search ..... 48/62 R, 87, 197 R,206, 48/210, 180 M, DIG. 2; 110/264, 265, 229; 122/5; 23/277 C; 261/DIG. 54, 76, 79 A, 17; 55/83, 261; 34/13, 57 R

[56] References Cited

U.S. PATENT DOCUMENTS

| | | | |
|---|---|---|---|
| 3,495,384 | 2/1970 | Alliger | 261/17 |
| 3,567,399 | 3/1971 | Altmann et al. | 23/277 C |
| 3,712,796 | 1/1973 | Sansom et al. | 23/277 C |
| 3,841,061 | 10/1974 | Pike | 261/62 |
| 4,013,427 | 3/1977 | Gernhardt et al. | 48/62 R |
| 4,054,424 | 10/1977 | Staudinger et al. | 48/197 R |

*Primary Examiner*—S. Leon Bashore
*Assistant Examiner*—George C. Yeung
*Attorney, Agent, or Firm*—Thomas H. Murray; Clifford A. Poff

[57] ABSTRACT

A stream of hot primary gas rising from the gasification region in a slag bath generator passes through an after-gasification region and thence into a cooling region. The stream of hot gas is cooled in the cooling region by injecting purified and cooled primary gas through tangentially-arranged nozzles at an outlet velocity of between 1 and 8 meters per second. Below the tangentially-arranged nozzles, other gas-cooling nozzles inject cooled and purified primary gas into the hot gas stream upwardly at an angle within 10°-60°, preferably at 45° and at an outlet velocity of between 10 and 160 meters per second. The upwardly-inclined gas injection nozzles are carried by the inner wall of an annular duct. The inner wall extends between a lining of cooling tubes surrounding the vertical gas flow space.

12 Claims, 4 Drawing Figures

GAS-COOLING METHOD AND APPARATUS

BACKGROUND OF THE INVENTION

This invention relates to a method and apparatus for cooling the primary gas produced in the gas generator having a vertical shaft operating under pressure at a high temperature wherein the hot primary gas produced in the gasification region is discharged vertically into an after-gasification region, both of which includes lining of cooling tubes extending to an upper cooling region having walls containing means for tangentially introducing a cooling gas into the stream of hot primary gas.

When finely-divided solid fuel is gasified, for example, at a high temperature in the slag bath generator, the fuel is injected together with a gasifying medium in the form of, for example, oxygen, steam or $CO_2$, by a set of nozzles into a melting chamber located within the lower portion of the gas generator. During the gasification process, the bottom of the melting chamber is covered with a liquid slag bath formed from the mineral constituents of the fuel. The resulting gases liberated during the gasification process consist chiefly of carbon monoxide and hydrogen. Gas generators of this type are usually operated at temperatures at which the slag is liquid. The liquid slag covering the bottom of the vertical reactor shaft flows toward and is discharged through a central overflow at the same rate as the slag is formed. The slag bath is kept in circular motion by a system of tangentially-arranged nozzles used to introduce fuel and a gasification agent. The bath of liquid slag forms a heat shield used to obtain very high flame temperatures. Strong turbulence in the rotating solid-gas phase above the radiating slag bath results in a rapid exchange of the gas film adhering to the solid fuel particles and accelerates the reaction due to the high temperature environment. The rising stream of very hot gas entrains a considerable amount of mineral fuel constituents in a pasty or molten form. The stream of gas initially flows vertically through an after-gasification region which is lined with cooling tubes. In an adjacent cooling region, cold gas which can take the form of cooled, purified production gas, is tangentially introduced at speeds between 20 and 40 meters per second. During this process, the cooling gas is subjected to centrifual and gravitational acceleration. The streams of cooling gas move along the container wall and follow spiral tracks downwardly. The cooling gas mixes with the rising hot primary gas, losing density through heat exchange. When the density of the cooling gas is adequately lowered, it is entrained by the primary gas which has been correspondingly cooled.

In this process, two faulty conditions occur. The first condition is erosion to the container wall by dust particles. This erosion occurs because the cooling gas is introduced at a high tangential speed to insure adequate mixing with the hot primary gas. Dust particles from the hot primary gas enter the stream of cold gas, thus causing the erosion to the container wall. The second condition is burning of the container wall by solidifying mineral constituents entrained in the hot primary gas. The mineral constituents burn on the container wall because when the cooling gas gradually loses tangential speed during its descent along the vertical shaft, the hot rising primary gas tends to travel around the edge of the cooling gas stream so that the solidifying mineral constituents entrained in the hot primary gas are brought into contact with the container wall and burn.

SUMMARY OF THE INVENTION

It is an object of the present invention to avoid the phenomenon occurring out of the two faulty conditions enumerated hereinbefore by using specially-designed apparatus and method for introducing cooling gas into a cooling region in a gas generator.

According to one aspect of the present invention, there is provided a gas-cooling apparatus for a high temperature gas generator, the combination including a cylindrical pressure shell forming a vertical shaft to conduct a stream of hot primary gas throughout a gasification region extending vertically to a superimposed after-gasification region which communicates with an adjacent cooling region thereabove, the pressure shell having a wall carrying a lining of cooling tubes surrounding a vertical and substantially cylindrical reactor shaft within the shell and extending along the gasification region and the after-gasification region, tangential gas injection nozzles carried in the upper cooling region by the wall of the pressure shell to inject cooling gas tangentially into the high temperature gas conducted along the reactor shaft, gas-cooling injection nozzles below the tangential gas injection nozzles to inject cooling gas into the hot stream of primary gas toward the vertical axis of the reactor shaft for constraining the hot stream of primary gas rising from the gasififer region and laden with dust toward the vertical axis of the reactor shaft.

According to a further aspect of the present invention, there is provided a method of cooling hot primary gas in a high temperature gas generator by the steps including conducting a stream of hot primary gas upwardly from a gasification region into a superimposed after-gasification region and thence into an adjacent cooling region thereabove, the stream of hot primary gas passing in succession along a vertical and substantially cylindrical reactor shaft through said regions, arranging cooling tubes to form a lining to surround the cylindrical reactor shaft extending along the gasification region and the after-gasification region, withdrawing hot primary gas from the cooling region, purifying the withdrawn primary gas, cooling the withdrawn primary gas, feeding the purified and cold primary gas through nozzles tangentially into the stream of hot primary gas in the cooling region to cool the hot primary gas and feeding purified and cooled primary gas through nozzles disposed below the tangentially-arranged nozzles to constrict the stream of hot primary gas rising from the gasifier region and laden with dust toward the central vertical axis of the cylindrical reactor shaft.

Thus, in both aspects according to the present invention, the vertical shaft of a gas generator communicates with discrete injection nozzles used to introduced a cooling gas tangentially above the gasification region and the after-gasification region while other discrete nozzles are disposed below the tangentially-arranged nozzles so that the hot stream of dust-laden primary arising from the gasification region is constrained toward the gasifier axis by the partial stream of cooling gas introduced through the lower set of gas-cooling injection nozzles.

In the preferred form of the present invention, the lower set of cooling gas injection nozzles is directed upwardly at an angle within the range of between 10° and 60°, preferably at an angle of approximately 45° to the horizontal. The nozzles for injecting cooling gas below the tangentially-arranged nozzles are distributed over a number of horizontal planes and at oppositely-disposed locations in each such plane. Advantageously, the nozzles are disposed at the inner wall of an annular duct surrounding the cooling tubes which, in turn, surround the after-gasification region. Webs interconnecting the cooling tubes are employed for welding the nozzles thereto. An annular slotted nozzle can be used and divided into nozzle portions, if desired, instead of employing individual cooling injection nozzles. Recycled production gas, after purifying and cooling, is preferably used as the cooling gas which is fed to both the tangentially-arranged set of nozzles as well as the nozzles angled upwardly below the tangentially-arranged nozzles.

The nozzles may take the form of tubes having an internal diameter of between 4 and 10 millimeters. The amount of cooling gas supplied through the nozzles per unit of time and the cross-sectional size of the nozzles can be made such that the outlet speed of the cooling gas discharged from the nozzles is between 10 and 160 meters per second. However, a large drop to the cooling gas velocity along the axis of each stream of cooling gas occurs due to an exchange of momentum between the cooling gas and the rising stream of hot production gas. Consequently, the stream of cooling gas retains only a small radial component of its velocity at the opposite part of the container wall and, therefore, there is no risk of entraining solid particles to cause erosion at this part of the container wall.

The jets of cooling gas used to constrict the rising stream of hot primary gas laden with dust toward the axis of the gasifier, prevent the hot primary gas from traveling around the edge of the stream of cooling gas. The use of such jets of cooling gas below the tangentially-arranged gas-cooling nozzles is employed for greatly reducing the outlet velocity of the cooling gas from the tangentially-arranged nozzles. The amount of cooling gas introduced per unit of time and the cross-sectional size of the tangentially-arranged nozzles can be made such that the outlet velocity of the gas is only within the range of about 1–8 meters per second. In this way, the solid entrained particles in the primary gas flowing above the trangentially-arranged nozzles are not likely to cause erosion in the cooling region of the gasifier.

These features and advantages of the present invention as well as others will be more fully understood when the following description is read in light of the accompanying drawings, in which.

Figure 1:
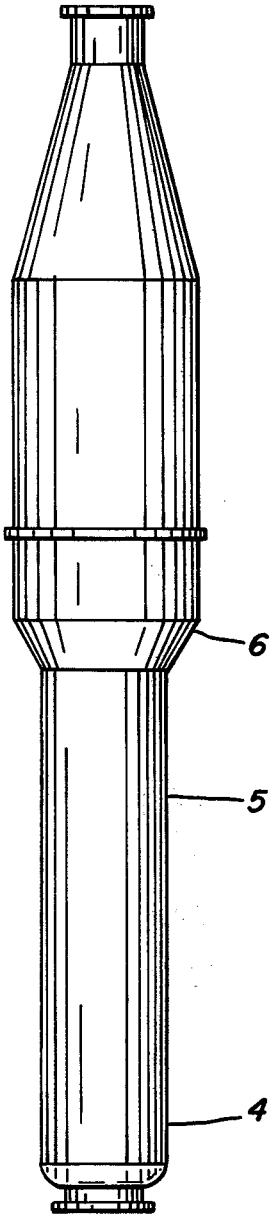
FIG. 1 is an elevational view of a gas generator for the high temperature gasification of coal.

In FIG. 1, there is illustrated a gas generator which includes a gasification region 4, an after-gasification region 5 vertically thereabove, and an overlying cooling region beginning with a portion identified by reference numeral 6. As is well known in the art, nozzles are used to introduce jet streams of fine-grain fuel and a gasification medium downwardly toward the surface of a slag bath in the bottom of the gasification region 4. The jet streams of fine-grain fuel and gasification medium impinge upon the surface of liquid slag which is discharged at the same rate it is produced through a centrally-arranged overflow in the bottom of the vessel. An operating pressure of about 25 atmospheres is usually maintained within the slag bath generator to facilitate the high temperature gasification of the fine-grain fuel. A cylindrical pressure shell is used to form a vertical shaft throughout which the stream of hot primary gas is conducted from the gasifier through the gasification region 4 and vertically through the after-gasification region 5 and thence into the cooling region located thereabove.

Figure 4:
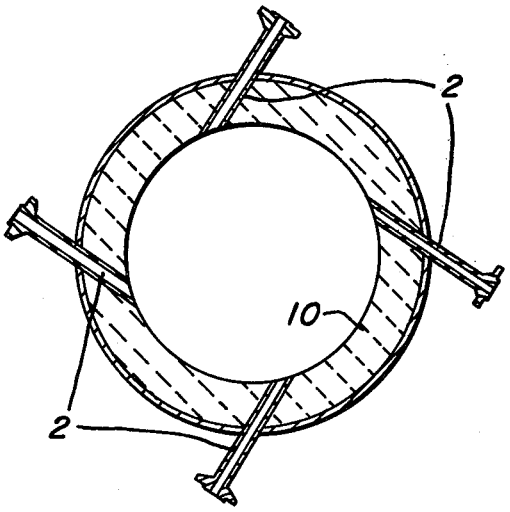
FIG. 4 is a sectional view taken along line IV—IV of FIG. 2.
Figure 2:
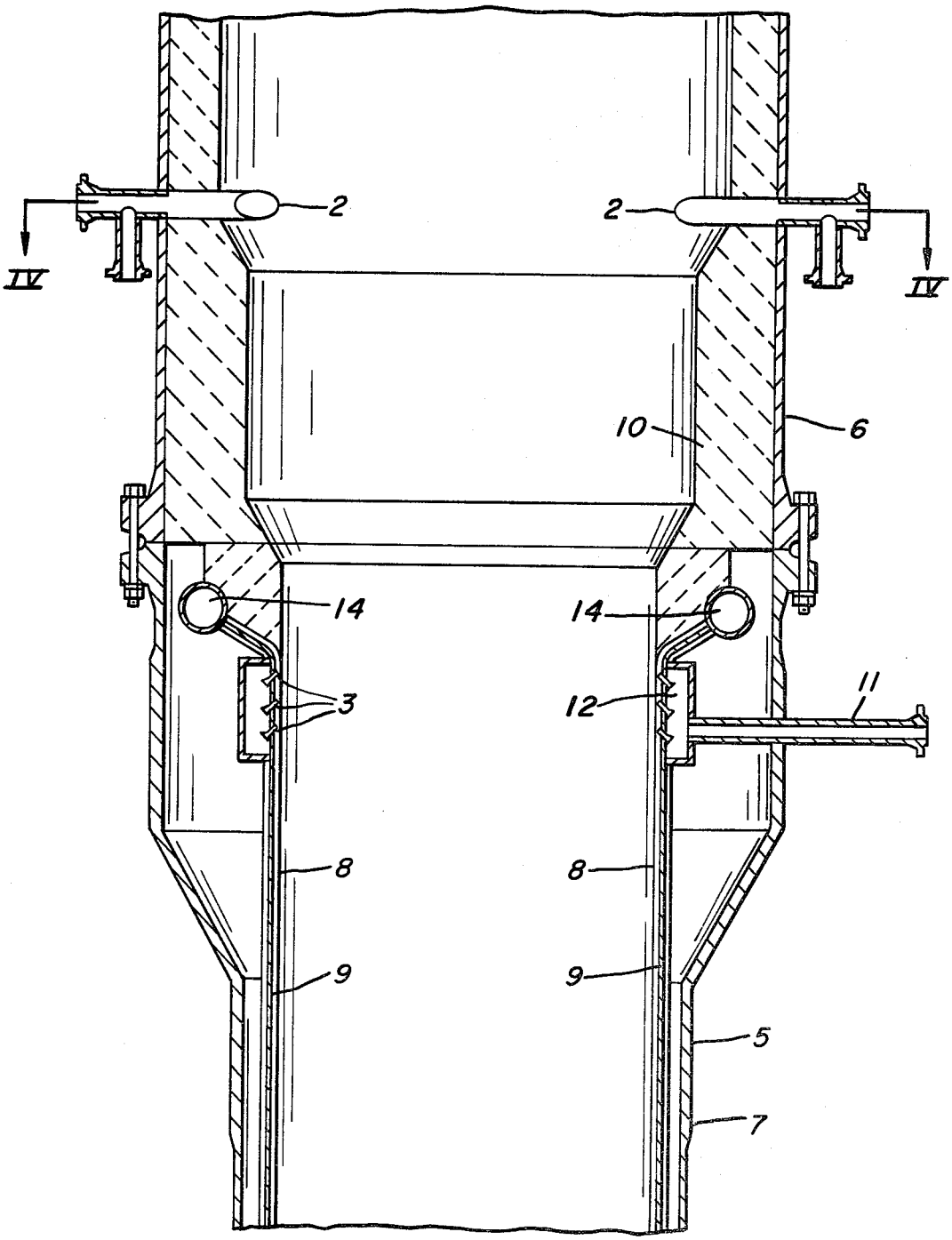
FIG. 2 is an enlarged view, in cross section, of the upper end of the after-gasification region and the cooling region thereabove.

As shown in FIG. 2, a metal pressure jacket 7 forms part of the cylindrical pressure shell that extends below the cooling region along the after-gasification region and gasifier region. The metal pressure jacket 7 is protected by a lining of cooling tubes 8 which is interconnected by webs 9. A header 14 is provided for a radiation-boiler cooling water. The header is coupled to the upper ends of the cooling tubes at a location within the after-gasification region just below the beginning of the cooling region 6. As illustrated in FIGS. 2 and 4, tangentially-arranged nozzles 2 extend into the vertical shaft within the cooling region for tangentially introducing cooling gas into the vertical shaft.

Figure 3:
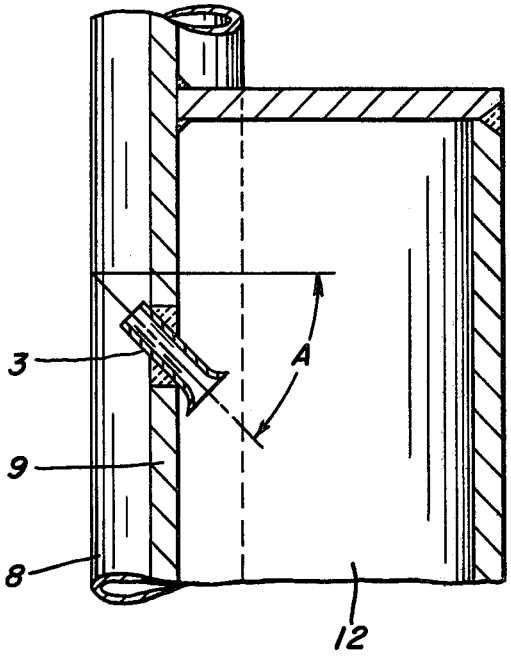
FIG. 3 is an enlarged view showing a nozzle of the lower set of gas-cooling injection nozzles illustrated in FIG. 2.

As illustrated in FIGS. 2 and 3, nozzles 3 are located below nozzles 2. The nozzles 3 are welded in webs 9 extending between the upper ends of cooling tubes 8. The webs 9 form the inner wall of an annular duct 12 communicating with an inlet spigot 11 for the delivery thereof of cooling gas. Nozzles 3 are positioned to inject streams of cooling gas upwardly at an angle, identified in FIG. 3 by reference character A, of between 10° to 60°, preferably at 45° to the horizontal.

Above the radiation boiler, the cooling region includes a pressure jacket 7 protected by a refractory lining 10. A partial flow from the stream of hot primary gas discharged from the upper end of the cooling region is recycled to provide the cooling gas which is supplied to the nozzles 2 as well as the nozzles 3. The partial flow of hot primary gas is purified including dust removal and cooling for its recycled use as a cooling gas.

As shown in FIG. 2, the nozzles 3 are disposed at opposite locations in horizontal planes vertically spaced from one another. One form of a suitable nozzle is a tube as shown in FIG. 3 having an internal diameter within the range of about 4 to 10 millimeters. The amount of cooling gas supplied through the nozzles 3 per unit of time within the range of internal diameters is selected so that a gas outlet speed is between 10 and 160 meters per second. The jets of cooling gas are injected upwardly to constrict the rising stream of hot, dust-laden primary gas toward the vertical axis of the gasifier, thus preventing the primary gas from traveling around the edges of the streams of cooling gas injected tangentially by nozzles 2. The amount of cooling gas introduced by nozzles 2 per unit of time is selected by designing the cross-sectional size of these nozzles so that there is an outlet velocity of the cooling gas within the range of about 1 to 8 meters per second. In this way, extrained solid particles are not likely to cause erosion to the wall of the cooling region. In view of the foregoing, it is now believed apparent that the cooling gas introduced through nozzles 3 passes obliquely upwardly at a high velocity whereas the cooling gas introduced through the tangentially-arranged nozzles 2 is introduced at a considerably lower speed. The novel use of these nozzles eliminates the risk of erosion to the container wall by dust particles entrained in the hot primary gas passing through the cooling region.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Gas-cooling apparatus for a high temperature gas generator, the combination including:

a cylindrical pressure shell forming a vertical shaft to conduct a stream of hot primary gas throughout a gasification region extending vertically to a superimposed after-gasification region which communicates with an adjacent cooling region thereabove, said pressure shell having a wall carrying a lining of cooling tubes surrounding a vertical and substantially cylindrical reactor shaft within said shell for extending along said gasification region and said after-gasification region, tangential gas injection nozzles carried in the upper cooling region by the wall of said pressure shell to inject cooling gas tangentially into the high temperature gas conducted by said reactor shaft, and gas-cooling injection nozzles below said tangential gas injection nozzles in said after-gasification region, said gas cooling injection nozzles being constructed to inject partial streams of cooling gas to penetrate into the hot stream of primary gas toward the vertical axis of said reactor shaft to constrain the hot stream of primary gas laden with dust rising from the gasifier region toward the vertical axis of the reactor shaft.

2. The gas-cooling apparatus according to claim 1 further including supports positioning said gas-cooling injection nozzles to direct each stream of coolant gas discharged therefrom upwardly at an angle of between 10° and 60° to the horizontal into the rising stream of hot primary gas.

3. The gas-cooling apparatus according to claim 1 further including supports positioning said gas-cooling injection nozzles to direct each stream of coolant gas discharged therefrom upwardly at an angle of approximately 45° to the horizontal into the rising stream of hot primary gas.

4. The gas-cooling apparatus according to claim 1 further including supports to carry said gas-cooling injection nozzles at opposite locations within each of a plurality of vertically-spaced horizontal planes.

5. The gas-cooling apparatus according to claim 1 further including an annular duct having an inner wall surrounding said lining of cooling tubes and carrying said gas-cooling injection nozzles.

6. The gas-cooling apparatus according to claim 5 wherein the inner wall of said annular duct includes web members interconnecting adjacent tubes, said gas-cooling injection nozzles being welded to said webs.

7. The gas-cooling apparatus according to claim 1 wherein said gas-cooling injection nozzles include tubes having an internal diameter of between 4 and 10 millimeters.

8. The gas-cooling apparatus according to claim 1 wherein said gas-cooling injection nozzles include nozzle members having annular slotted gas discharge openings.

9. The gas-cooling apparatus according to claim 8 wherein said nozzle members divide each discharge opening into a plurality of openings.

10. A method of cooling hot primary gas in a high temperature gas generator, the steps including:

conducting a stream of hot primary gas upwardly from a gasification region into a superimposed after-gasification region and thence into an adjacent cooling region thereabove, the stream of hot primary gas passing in succession along a vertical and substantially cylindrical reactor shaft through said regions, arranging cooling tubes to form a lining to surround the cylindrical reactor shaft along said gasification region and said after-gasification region, withdrawing primary gas from the cooling region, purifying the withdrawn primary gas, cooling the withdrawn primary gas, feeding the purified and cooled primary gas through nozzles tangentially into the stream of hot primary gas in said cooling region, and feeding partial streams of purified and cooled primary gas in said after-gasification region through nozzles disposed below the tangentially-arranged nozzles into the stream of hot primary gas to constrict the stream of hot primary gas laden with dust rising from the gasification region toward the central vertical axis of said cylindrical reactor shaft.

11. The method according to claim 10 wherein said nozzles disposed below the tangentially-arranged nozzles have a cross-sectional size to discharge purified and cooled primary gas at an outlet velocity of between 10 and 160 millimeters per second.

12. The method according to claim 10 wherein the nozzles to feed purified and cooled primary gas tangentially into the stream of hot primary gas have a cross-sectional size to discharge purified and cooled primary gas at an outlet velocity of between 1 and 8 millimeters per second.

* * * * *